US009318279B2

(12) United States Patent
Cao

(10) Patent No.: US 9,318,279 B2
(45) Date of Patent: Apr. 19, 2016

(54) BUTTON ASSEMBLY AND ELECTRONIC DEVICE WITH THE SAME

(71) Applicant: ScienBiziP Consulting (Shen Zhen) Co., Ltd., Shenzhen (CN)

(72) Inventor: Yan-Bang Cao, Shenzhen (CN)

(73) Assignee: ScienBiziP Consulting (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/525,669

(22) Filed: Oct. 28, 2014

(65) Prior Publication Data

US 2015/0213973 A1 Jul. 30, 2015

(30) Foreign Application Priority Data

Jan. 24, 2014 (CN) ..... 2014 1 0032990

(51) Int. Cl.
*H01H 13/06* (2006.01)
*H01H 13/10* (2006.01)

(52) U.S. Cl.
CPC ..... *H01H 13/06* (2013.01); *H01H 13/10* (2013.01); *H01H 2223/002* (2013.01)

(58) Field of Classification Search
CPC ..... H01H 2223/002; H01H 2203/028; H01H 3/86; H01H 13/06; H01H 13/10
USPC ..... 200/302.1, 302.2, 511, 512, 341, 345
See application file for complete search history.

(56) References Cited

U.S. PATENT DOCUMENTS 4,331,852 A * 5/1982 Baran ..... H01H 13/52 200/302.2
4,376,239 A * 3/1983 Long ..... H01H 13/705 200/302.2
6,705,783 B1 * 3/2004 Bowen ..... G06F 3/0202 341/176
6,963,039 B1 * 11/2005 Weng ..... H01H 23/06 200/302.1

* cited by examiner

*Primary Examiner* — Edwin A. Leon
(74) *Attorney, Agent, or Firm* — Novak Druce Connolly Bove + Quigg LLP

(57) ABSTRACT

A button assembly includes a keycap, a washer, a positioning member, and a fixing member. The keycap includes a resisting member and an operating member. The operating member extends through a through hole of a sidewall of an electronic device and extends external to the sidewall of the electronic device. The washer is provided between the resisting member and the sidewall to seal a gap between the resisting member and the sidewall. The washer pivots on the operating member. The positioning member is fixed to a bottom of the electronic device. The positioning member separates from the sidewall of the electronic device by a preset distance. The fixing member affixes a flexible circuit board of the electronic device to the positioning member. The fixing member is provided to position a switch of the flexible circuit board abutting against the resisting member at a position opposite to the keycap.

8 Claims, 3 Drawing Sheets

BUTTON ASSEMBLY AND ELECTRONIC DEVICE WITH THE SAME

CROSS-REFERENCE TO RELATED APPLICATIONS

This application claims priority to Chinese Patent Application No. 201410032990.7 filed on Jan. 24, 2014, the contents of which are incorporated by reference herein.

FIELD

The subject matter herein generally relates to button assemblies, and particularly, to a button assembly capable of holding dust or water out of an electronic device.

BACKGROUND

A button assembly of an electronic device is usually received in a through hole of a sidewall of the electronic device. A gap may be existed between the button assembly and the sidewall.

BRIEF DESCRIPTION OF THE DRAWINGS

Implementations of the present technology will now be described, by way of example only, with reference to the attached figures.

DETAILED DESCRIPTION

Figure 1:
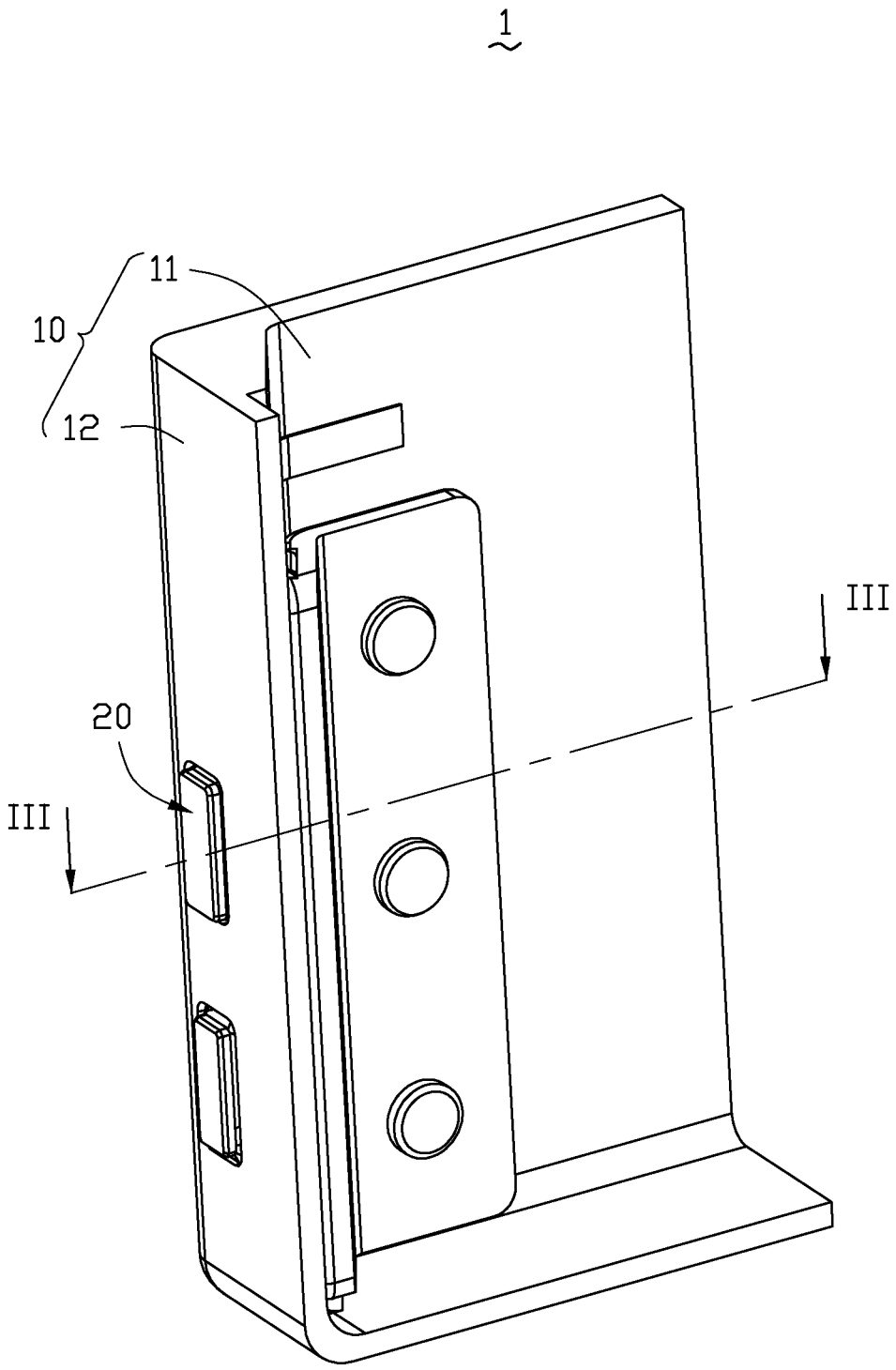
FIG. 1 is an isometric view of an embodiment of a part of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

Embodiments of the present disclosure will be described with reference to the accompanying drawings.

Figure 2:
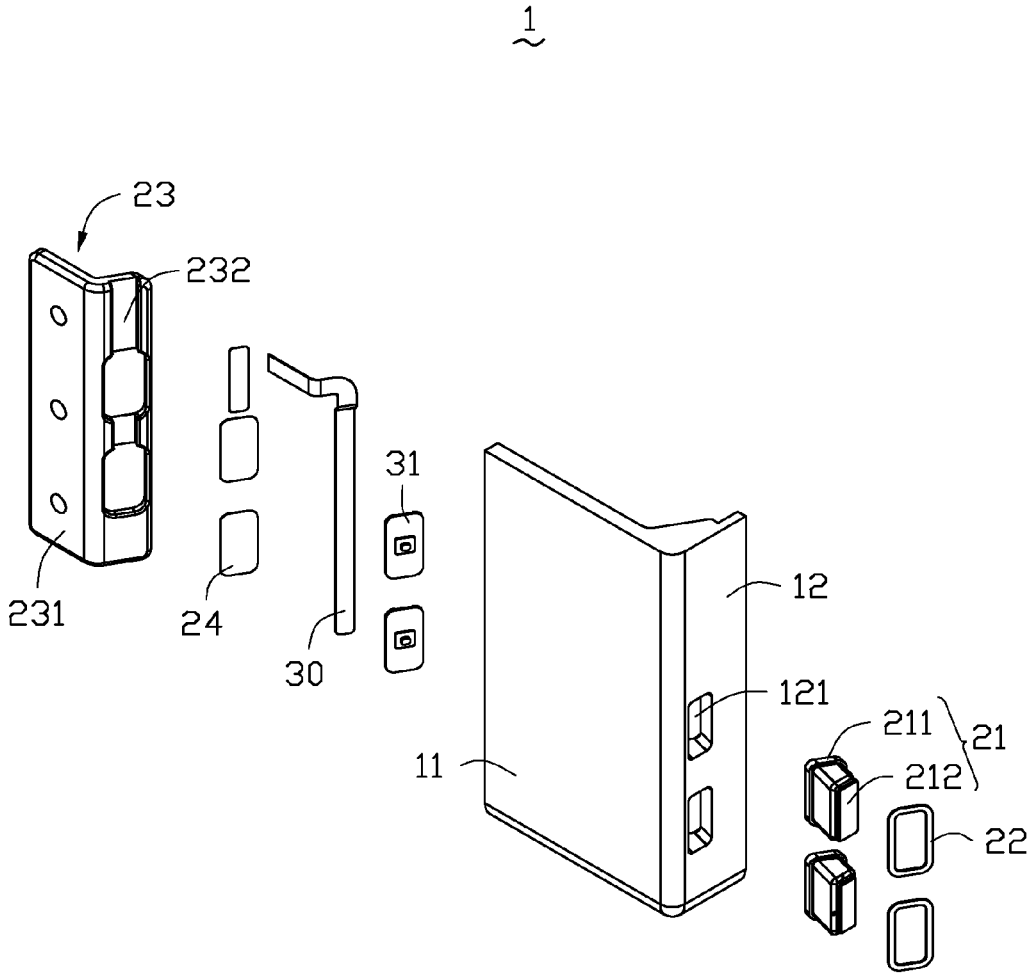
FIG. 2 is an exploded, isometric view of the electronic device of FIG. 1.

FIGS. 1-2 illustrate an embodiment of an electronic device 1. The electronic device 1 can include a rear cover 10, a button assembly 20, and a flexible circuit board 30. The rear cover 10 can include a bottom 11 and a sidewall 12. The sidewall 12 protrudes from one side edge of the bottom 11. The sidewall 12 defines a through hole 121. The button assembly 20 is partially movably received in the through hole 121. The flexible circuit board 30 includes a switch 31. The switch 31 can generate a corresponding signal when the button assembly 20 actuates the switch 31. In the embodiment, the switch 31 can be a reset switch.

The button assembly 20 can include a keycap 21, a washer 22, a positioning member 23, and a fixing member 24. The keycap 21 can include a resisting member 211 and an operating member 212. The operating member 212 extends substantially perpendicularly from the resisting member 211. The operating member 212 extends through the through hole 121 and extends external to the sidewall 12 to be operated by a user.

The washer 22 is pivoted on the operating member 212 and arranged between the resisting member 211 and the sidewall 12. The washer 22 seals a gap between the resisting member 211 and the sidewall 12. In the embodiment, the washer 22 is made of a dust-absorbing material or a waterproof material, such as rubber.

The positioning member 23 is fixed to the bottom 11 and is separated from the sidewall 12 by a preset distance.

The fixing member 24 can affix the flexible circuit board 30 to the positioning member 23, and position the switch 31 to be opposite to the resisting member 211 and abut against the resisting member 211. The keycap 21 is accordingly positioned at the sidewall 12 via the switch 31. The washer 22 is accordingly resisted toward the sidewall 12 by the resisting member 211. Thus the washer 22 can seal the gap between the resisting member 211 and the sidewall 12 to absorb the dust or create a waterproof seal, which causes the dust or the water to be held out of the electronic device 1 by the washer 22. In the embodiment, the fixing member 24 is an adhesive tape.

Figure 3:
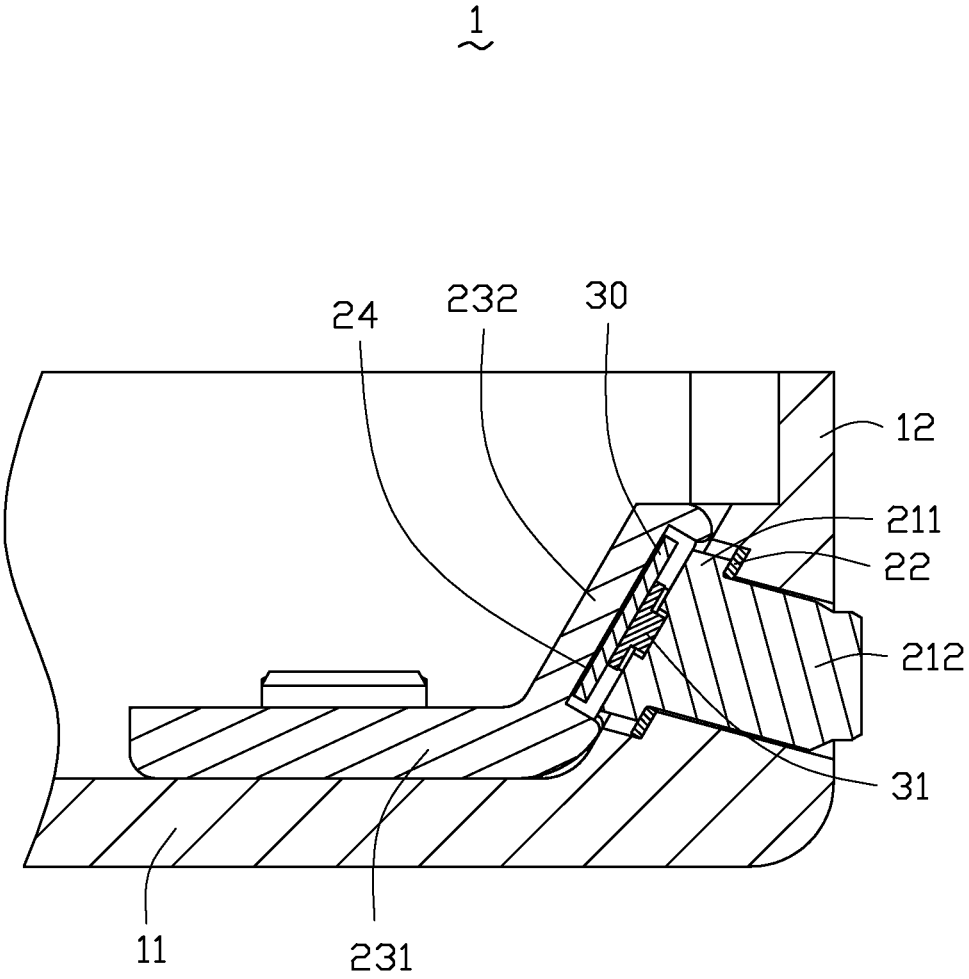
FIG. 3 is a cross-sectional view taken along line III-III of FIG. 1.

When the operating member 212 is depressed, the operating member 212 can bring the resisting member 211 to move inward, the resisting member 211 can actuate the switch 31, and the switch 31 can generate the corresponding signal. When the operating member 212 is released, the switch 31 can provide a rebound force to move the keycap 21 toward the sidewall 12 (see FIG. 3).

In the embodiment, the positioning member 23 can include a main body 231 and a positioning plate 232. The main body 231 is attached to the bottom 11 of the rear cover 10. A first end of the positioning plate 232 is fixed to the main body 231, and a second end of the positioning plate 232 is free. The positioning plate 232 slopes with the main body 231. The positioning plate 232 is separated from the sidewall 12 by the preset distance. The fixing member 24 affixes the flexible circuit board 30 to the positioning plate 232 of the positioning member 23.

When the operating member 212 is depressed, the resisting member 211 further pushes a second end of the positioning plate 232 to move inward. When the operating member 212 is released, the second end of the positioning plate 232 and the switch 31 respectively provide the rebound force to move the keycap 21 toward the sidewall 12.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A button assembly comprising:

a keycap comprising a resisting member and an operating member, the operating member extending substantially perpendicular from the resisting member, the operating member being configured to extend through a through hole of a sidewall of an electronic device and being configured to extend external to the sidewall of the electronic device;

a washer provided between the resisting member and the sidewall to seal a gap between the resisting member and the sidewall, the washer being configured to pivot on the operating member;

a positioning member fixed to a bottom of the electronic device, the positioning member being configured to separate from the sidewall of the electronic device by a preset distance; and a fixing member configured to affix a flexible circuit board of the electronic device to the positioning member, the fixing member being provided to position a switch of the flexible circuit board abutting against the resisting member at a position opposite to the keycap;

the keycap positioned at the sidewall via the switch, the resisting member being provided to bias the washer toward the sidewall to seal a gap between the resisting member and the sidewall.

2. The button assembly as described in claim 1, wherein the positioning member comprises a main body and a positioning plate; the main body is configured to be fixed to the bottom of the electronic device; a first end of the positioning plate is fixed to the main body, and a second end of the positioning plate is free, the positioning plate slopes with the main body, the positioning plate is configured to be separated from the sidewall by the preset distance; and the fixing member is configured to affix the flexible circuit board to the positioning plate.

3. The button assembly as described in claim 1, wherein the fixing member is an adhesive tape.

4. The button assembly as described in claim 1, wherein the washer is made of a dust-absorbing material or a waterproof material.

5. An electronic device comprising:

a rear cover comprising a bottom and a sidewall, the sidewall defining a through hole;

a flexible circuit board comprising a switch; and a button assembly comprising:

a keycap comprising a resisting member and an operating member, the operating member extending substantially perpendicular from the resisting member, the operating member extending through the through hole and extending external to the sidewall;

a washer provided between the resisting member and the sidewall to seal a gap between the resisting member and the sidewall, the washer pivoting on the operating member;

a positioning member fixed to a bottom of the electronic device, the positioning member being configured to separate from the sidewall by a preset distance; and a fixing member affixing the flexible circuit board to the positioning member, the fixing member being provided to position a switch of the flexible circuit board abutting against the resisting member at a position opposite to the keycap;

the keycap positioned at the sidewall via the switch, the resisting member being provided to bias the washer toward the sidewall to seal a gap between the resisting member and the sidewall.

6. The electronic device as described in claim 5, wherein the positioning member comprises a main body and a positioning plate; the main body is fixed to the bottom; a first end of the positioning plate is fixed to the main body, and a second end of the positioning plate is free, the positioning plate slopes with the main body, the positioning plate is separated from the sidewall by the preset distance; and the fixing member affixes the flexible circuit board to the positioning plate.

7. The electronic device as described in claim 5, wherein the fixing member is an adhesive tape.

8. The electronic device as described in claim 5, wherein the washer is made of a dust-absorbing material or a waterproof material.

* * * * *